US009400445B2

(12) United States Patent
Matsuura

(10) Patent No.: US 9,400,445 B2
(45) Date of Patent: Jul. 26, 2016

(54) IMAGE FORMING APPARATUS

(71) Applicant: BROTHER KOGYO KABUSHIKI KAISHA, Nagoya-shi, Aichi-ken (JP)

(72) Inventor: Minoru Matsuura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/810,516

(22) Filed: Jul. 28, 2015

(65) Prior Publication Data

US 2016/0026112 A1 Jan. 28, 2016

(30) Foreign Application Priority Data

Jul. 28, 2014 (JP) ..... 2014-153195

(51) Int. Cl.
*G03G 15/043* (2006.01)

(52) U.S. Cl.
CPC ..... *G03G 15/043* (2013.01); *G03G 2215/0141* (2013.01)

(58) Field of Classification Search
CPC ..... G03G 15/043; G03G 15/0415
See application file for complete search history.

(56) References Cited

U.S. PATENT DOCUMENTS

2002/0063908 A1 5/2002 Ito et al.
2007/0210245 A1* 9/2007 Maeda ..... G02B 26/125 250/234
2008/0049094 A1 2/2008 Kato et al.
2012/0162670 A1* 6/2012 Ohnishi ..... G03G 15/0189 358/1.4
2013/0208069 A1* 8/2013 Zaima ..... G03G 15/043 347/118
2013/0286141 A1* 10/2013 Iwamoto ..... G03G 15/043 347/224

FOREIGN PATENT DOCUMENTS

JP 2002-139688 A 5/2002
JP 2004-286862 A 10/2004
JP 2008-046548 A 2/2008

* cited by examiner

*Primary Examiner* — Rodney Bonnette
(74) *Attorney, Agent, or Firm* — Scully, Scott, Murphy & Presser, P.C.

(57) ABSTRACT

An image forming apparatus includes an exposing device including: light sources including light emitting portions and respectively for photoconductors; a deflector for deflecting light from each light emitting portion; optical systems each for using the deflected light to form an image on the photoconductor; and a first beam detector for detecting reference light deflected by the deflector. A storage stores parameters respectively for the light emitting portions. Each of the parameters relates to a writing time extending from the detection of the reference light to emission of light for exposing a surface of the photoconductor from the light emitting portion. A controller controls the timing of emission of light from each light emitting portion for exposing the surface of the photoconductor, based on a result of the detection of the reference light and a corresponding one of the parameters.

20 Claims, 6 Drawing Sheets

LD1
LD12
LD11
D2
D0
D1

1
100
110
120
III
60(60Y)
72
74(74Y)
80A
LY
LM
50
40
60
151
30
71
LD1
LD2
LD3
LD4
20(20Y)
20(20M)
20(20C)
20(20K)
21
22
LC
LK
60(60K)
74(74K)
80B
RIGHT
FRONT
LEFT
REAR

FIG.5

BODY MEMORY

| | REFERENCE VALUE |
|---|---|
| LD11 | T11 |
| LD21 | T21 |
| LD31 | T31 |
| LD41 | T41 |

FIG.6A

MEMORY

| | DEVIATION AMOUNT |
|---|---|
| LD11 | ΔT11 |
| LD21 | ΔT21 |
| LD31 | ΔT31 |
| LD41 | ΔT41 |

FIG.6B

MEMORY

| | TIME DIFFERENCE BETWEEN FIRST AND SECOND LIGHT EMISSION POINTS |
|---|---|
| LD12 | ΔT1 |
| LD22 | ΔT2 |
| LD32 | ΔT3 |
| LD42 | ΔT4 |

IMAGE FORMING APPARATUS

CROSS REFERENCE TO RELATED APPLICATION

The present application claims priority from Japanese Patent Application No. 2014-153195, which was filed on Jul. 28, 2014, the disclosure of which is herein incorporated by reference in its entirety.

BACKGROUND

1. Technical Field

The following disclosure relates to (i) an image forming apparatus including an exposing device for exposing a surface of a photoconductor using a light source including a plurality of light emitting portions and (ii) a control method of controlling the image forming apparatus.

2. Description of the Related Art

There is conventionally known an image forming apparatus in the form of a monochrome printer including: a scanner including a multi-beam laser having a plurality of light emitting portions; and a photoconductive drum which is exposed by light emitted from each of the light emitting portions. In this technique, a single writing sensor detects light emitted from each of the light emitting portions to obtain a writing timing of the light.

SUMMARY

Incidentally, in the case where the above-described construction is employed for a color printer, writing sensors have to be provided respectively for multi-beam lasers for respective colors, resulting in a complicated structure of the printer and higher cost.

Accordingly, an aspect of the disclosure relates to an image forming apparatus having a simple structure and including a plurality of light sources having a plurality of light emitting portions and to a control method of controlling the image forming apparatus.

In one aspect of the disclosure, an image forming apparatus includes: an exposing device configured to expose surfaces of a plurality of photoconductors; a storage; and a controller. The exposing device includes: a plurality of light sources including a plurality of light emitting portions and provided respectively corresponding to the plurality of photoconductors; a single deflector configured to deflect light emitted from each of the plurality of light emitting portions of the plurality of light sources; a plurality of optical systems each configured to use the light deflected by the deflector to form an image on a corresponding one of the plurality of photoconductors; and a first beam detector configured to detect reference light emitted from one of the plurality of light emitting portions and deflected by the deflector. The storage is configured to store a plurality of parameters respectively for the plurality of light emitting portions, the plurality of parameters each relating to a writing time extending from a timing of the detection of the reference light by the first beam detector to a timing of emission of light for exposing a corresponding one of the surfaces of the plurality of photoconductors from a corresponding one of the plurality of light emitting portions. The controller is configured to control the timing of emission of light from each of the plurality of light emitting portions for exposing a corresponding one of the surfaces of the plurality of photoconductors, based on a result of the detection of the reference light by the first beam detector and a corresponding one of the plurality of parameters stored in the storage.

Another aspect of the disclosure provides a control method of controlling an image forming apparatus. The image forming apparatus includes: an exposing device configured to expose surfaces of a plurality of photoconductors; and a storage. The exposing device includes: a plurality of light sources including a plurality of light emitting portions and provided respectively corresponding to the plurality of photoconductors; a deflector configured to deflect light emitted from each of the plurality of light emitting portions of the plurality of light sources; a plurality of optical systems each configured to use the light deflected by the deflector to form an image on a corresponding one of the plurality of photoconductors; and a first beam detector configured to detect reference light emitted from any one of the plurality of light emitting portions and deflected by the deflector. The control method includes: storing a plurality of parameters respectively for the plurality of light emitting portions into the storage, the plurality of parameters each relating to a writing time extending from a timing of the detection of the reference light by the first beam detector to a timing of emission of light for exposing a corresponding one of the surfaces of the plurality of photoconductors from a corresponding one of the plurality of light emitting portions; and controlling a timing of emission of light from each of the plurality of light emitting portions for exposing a corresponding one of the surfaces of the plurality of photoconductors, based on a result of the detection of the reference light by the first beam detector and a corresponding one of the plurality of parameters stored in the storage.

Accordingly, the timing of emission of light for exposing the surface of the photoconductor from each of the light emitting portions can be controlled using only a result of detection of the single writing sensor. This configuration eliminates the need of a plurality of writing sensor, resulting in a simple construction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIG. 5 is a view illustrating reference values of writing times which are stored in a body memory;

FIG. 6A is a view illustrating deviation amounts stored in a memory, and FIG. 6B is a view illustrating time differences between first light emitting portions and second light emitting portions.

DETAILED DESCRIPTION OF THE EMBODIMENT

Hereinafter, there will be described one embodiment by reference to the drawings. It is noted that an overall construction of a color printer 200 as one example of an image forming apparatus will be explained first, and then features of the present disclosure will be explained in detail.

Figure 1:
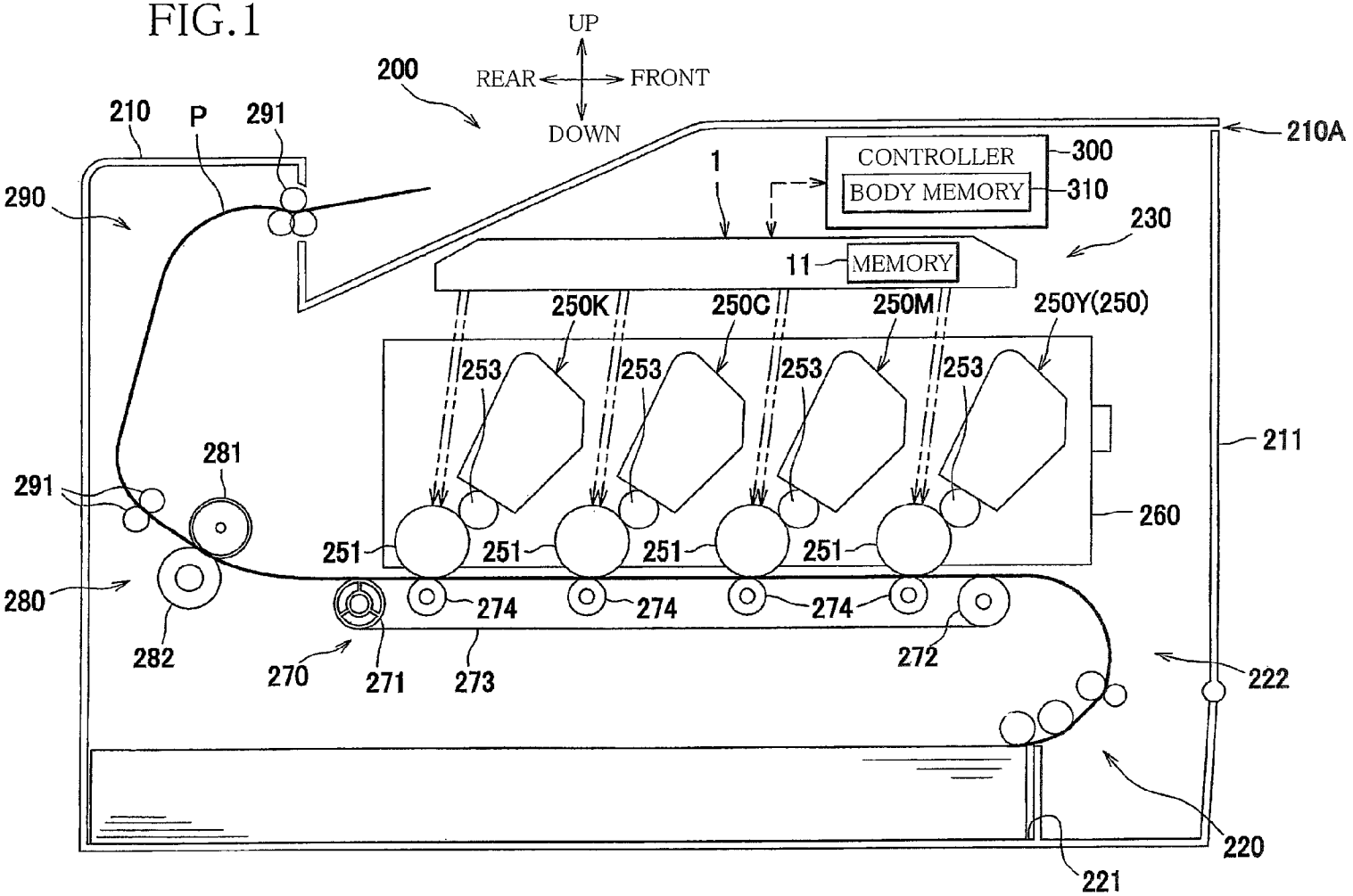
FIG. 1 is a view illustrating a color printer according to one embodiment.

In the following explanation, each direction is described with respect to a user using the color printer 200. That is, the right side of the illustrated surface of the sheet of FIG. 1 is defined as a front side, the left side as a rear side, the back side as a right side, and the front side as a left side. The up and down direction in the illustrated surface of the sheet of FIG. 1 is defined as an up and down direction.

As illustrated in FIG. 1, the color printer 200 includes: a sheet-supply unit 220 configured to supply a sheet P; an image forming device 230 configured to form an image on the supplied sheet P; a sheet-output unit 290 configured to discharge the sheet P on which the image has been formed; and a controller 300. The sheet-supply unit 220, the image forming device 230, the sheet-output unit 290, and the controller 300 are arranged in a body housing 210.

The sheet-supply unit 220 includes a sheet-supply tray 221 accommodating the sheets P, and a sheet conveying mechanism 222 configured to convey each sheet P from the sheet-supply tray 221 to the image forming device 230.

The image forming device 230 includes a scanner unit 1 as one example of the exposing device, four process cartridges 250, a holder 260, a transfer unit 270, and a fixing device 280.

The scanner unit 1 is a device for exposing surfaces of a plurality of photoconductive drums 251. This scanner unit 1 is provided in an upper portion of the body housing 210. It is noted that the scanner unit 1 and the controller 300 for controlling this scanner unit 1 will be explained in detail.

The process cartridges 250 are provided above the sheet-supply unit 220 so as to be arranged in the front and rear direction. Each of the process cartridges 250 includes the photoconductive drum 251 as one example of a photoconductor, a well-known charging unit, not shown, a developing roller 253, and a toner storage chamber. Each process cartridge 250 stores a toner of a corresponding one of four colors, namely, black, cyan, magenta, and yellow. It is noted that when referring to the process cartridge 250 and the photoconductive drum 251 for a toner of a particular color in this specification and drawings, a corresponding one of suffixes K, C, M, and Y respectively indicating black, cyan, magenta, and yellow is attached.

The holder 260 integrally holds the four process cartridges 250 and is movable in the front and rear direction through an opening 210A which is formed by opening a front cover 211 provided on the front side of the body housing 210.

The transfer unit 270 is provided between the sheet-supply unit 220 and the four process cartridges 250. The transfer unit 270 includes a drive roller 271, a driven roller 272, a conveyor belt 273, and four transfer rollers 274.

The drive roller 271 and the driven roller 272 are spaced apart from each other in the front and rear direction and arranged in parallel. The conveyor belt 273 as an endless belt is tensioned between the drive roller 271 and the driven roller 272. Inside the conveyor belt 273, the four transfer rollers 274 are arranged opposite to the respective photoconductive drums 251 such that the conveyor belt 273 is nipped by the transfer rollers 274 and the photoconductive drums 251.

The fixing device 280 is disposed behind the four process cartridges 250 and the transfer unit 270. The fixing device 280 includes a heat roller 281 and a pressure roller 282 which is disposed opposite to the heat roller 281 so as to be pressed against the heat roller 281.

In the image forming device 230 constructed as described above, the surface of each photoconductive drum 251 is electrostatically charged uniformly by the charging unit and exposed by the scanner unit 1. As a result, an electrostatic latent image is formed on each photoconductive drum 251 based on image data. The developing roller 253 thereafter supplies the toner from the toner storage chamber to the electrostatic latent image formed on the photoconductive drum 251, so that a toner image is formed on the photoconductive drum 251.

When the sheet P supplied onto the conveyor belt 273 is then conveyed through an area between the photoconductive drums 251 and the respective transfer rollers 274, the toner images formed on the respective photoconductive drums 251 are transferred onto the sheet P. The fixing device 280 thermally fixes the toner images transferred on the sheet P.

The sheet-output unit 290 includes a plurality of conveying rollers 291 for conveying the sheet P. The sheet P to which the transferred toner images are thermally fixed is conveyed by the conveying rollers 291 and discharged to an outside of the body housing 210.

Next, the structure of the scanner unit 1 will be explained in detail. In the following explanation, a main scanning direction coincides with a scanning direction in which laser lights LY, LM, LC, LK are scanned over the surfaces of the respective photoconductive drums 251. In this specification, all directions in which the laser lights LY, LM, LC, LK are deflected for this scanning will be referred to as the main scanning direction even if each of the directions does not spatially coincide with the main scanning direction. A sub-scanning direction is perpendicular to the main scanning direction and a direction of travel of each of the laser lights LY, LM, LC, LK.

Figures 2A, 2B:
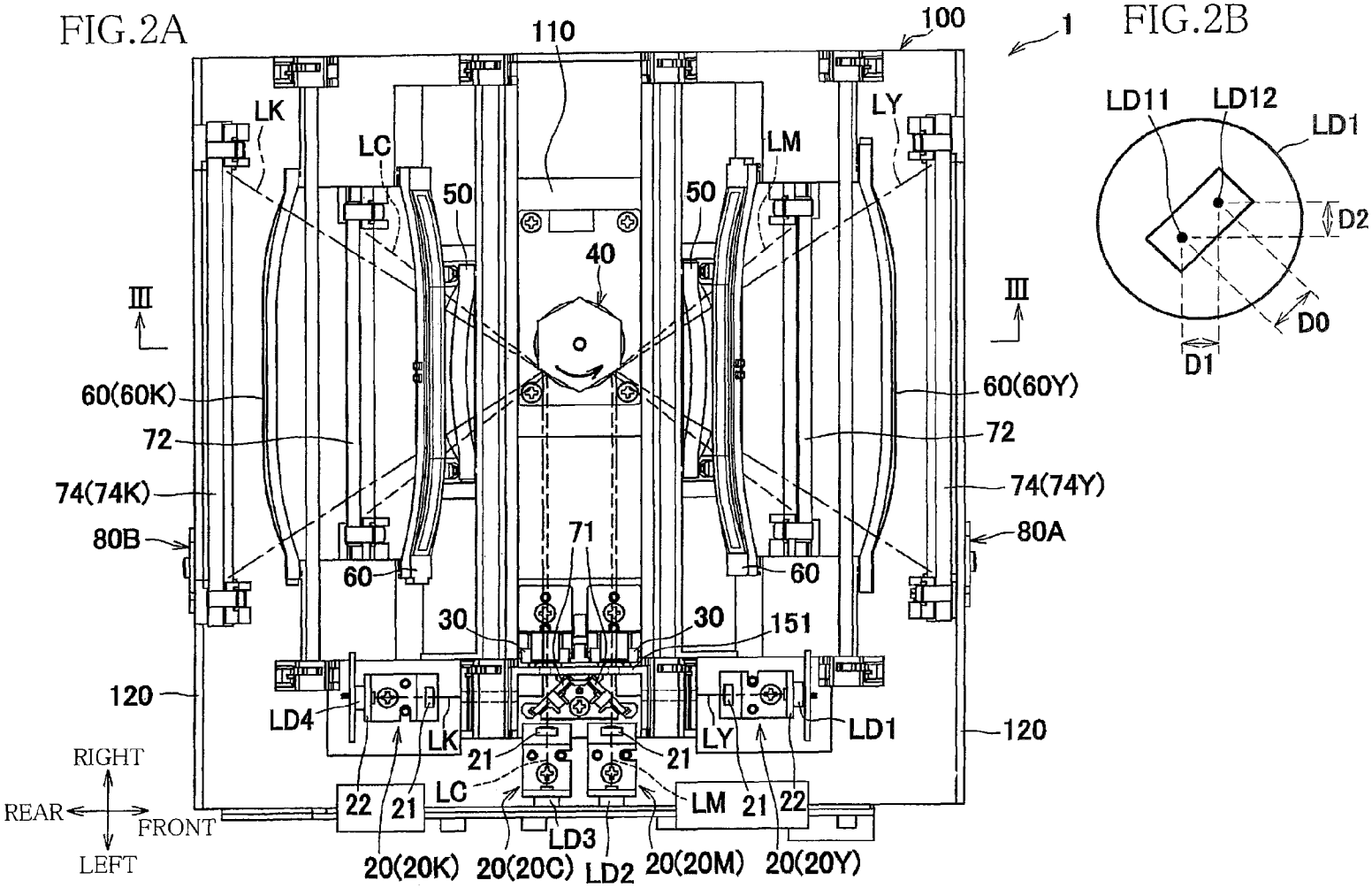
FIG. 2A is a plan view illustrating a scanner unit.
FIG. 2B is a view illustrating light emitting portions of a multi-beam laser.
Figure 3:
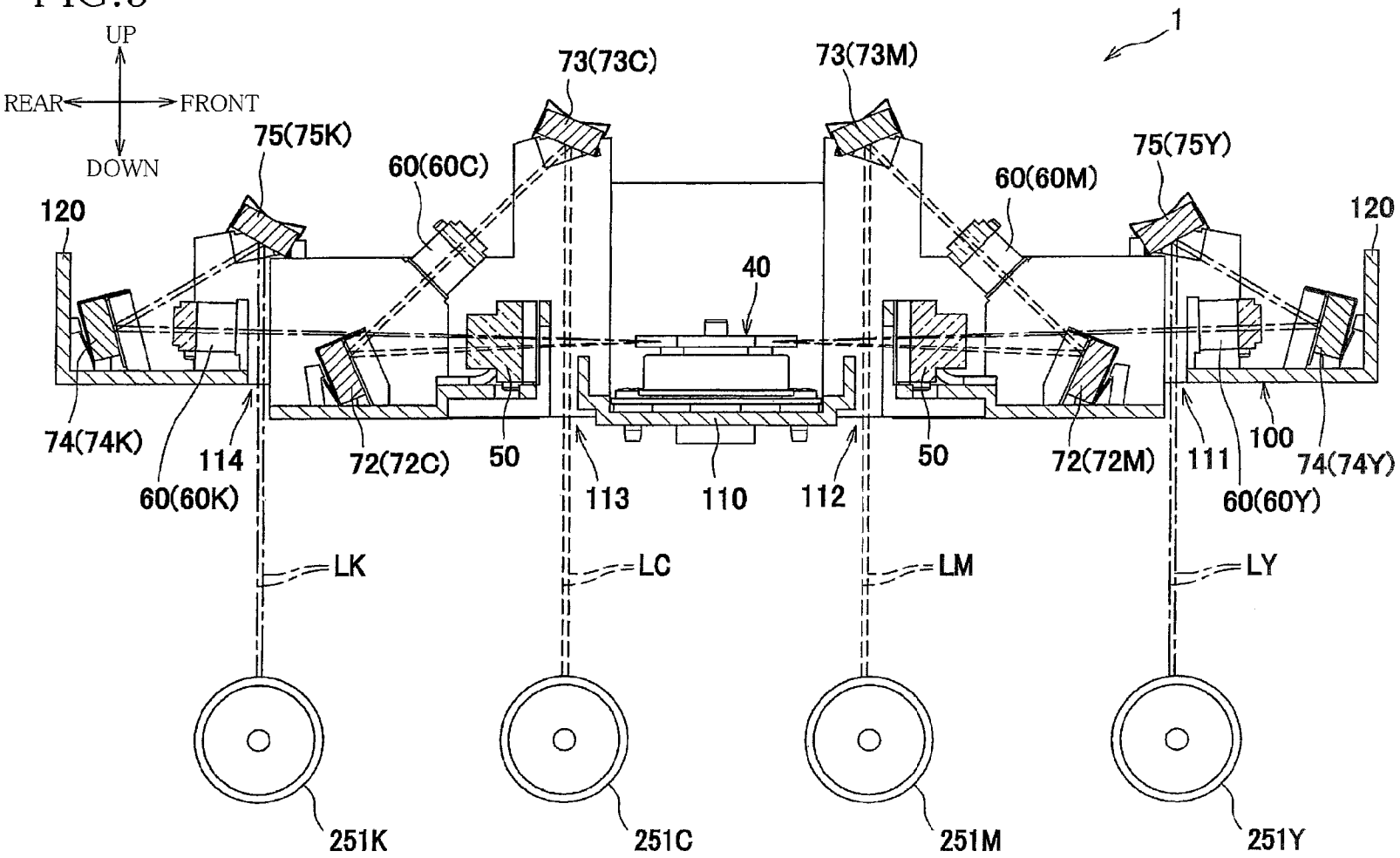
FIG. 3 is a cross-sectional view taken along line in FIG. 2.

As illustrated in FIGS. 2A and 3, the scanner unit 1 includes light source devices 20 (20Y, 20M, 20C, 20K), first cylindrical lenses 30, a single polygon mirror 40 as one example of a deflector, two fθ lenses 50, four second cylindrical lenses 60, reflective mirrors 71-75, a writing sensor 80A, a correction sensor 80B, a casing 100, and a memory 11 (see FIG. 1) as one example of a storage.

Each of the light source devices 20Y, 20M, 20C, 20K emits two laser lights (LY, LM, LC, LK), for example, the light source device 20Y emits the two laser lights LY (see FIG. 3). The light source devices 20Y, 20M, 20C, 20K are provided corresponding to the respective photoconductive drums 251Y, 251M, 251C, 251K to be scanned and exposed by the scanner unit 1. The light source device 20M and the light source device 20C are arranged next to each other in the front and rear direction. The light source device 20Y and the light source device 20K are arranged so as to face each other in the right and left direction. These light source devices are arranged such that the laser lights LY, LK emitted by the respective light source devices 20Y, 20K are substantially perpendicular to the laser lights LM, LC emitted by the respective light source devices 20M, 20C.

Each of the light source devices 20Y-20K includes a corresponding one of multi-beam lasers LD1-LD4 each as one example of a light source, a coupling lens 21, and a frame 22. As illustrated in FIG. 2B, the multi-beam laser LD1 is a semiconductor laser array having two light emitting portions LD11, LD12 spaced apart from each other at a predetermined distance D0. The multi-beam laser LD1 is fixed to the frame 22 of the corresponding light source device 20 at a particular angle such that the light emitting portions LD11, LD12 are spaced apart from each other at a first distance D1 in the main scanning direction and at a second distance D2 in the sub-scanning direction.

It is noted that each of the other multi-beam lasers LD2, LD3, LD4 has a structure and an arrangement similar to those of the multi-beam laser LD1. Specifically, the multi-beam laser LD2 (LD3, LD4) has two light emitting portions LD21, LD22 (LD31, LD32; LD41, LD42) which are spaced apart from each other at the first distance D1 in the main scanning direction and at the second distance D2 in the sub-scanning direction.

As illustrated in FIG. 2A, each of the laser lights (LY-LK) is emitted, while diverging, from each light emitting portion of a corresponding one of the multi-beam lasers LD1-LD4, and each of the coupling lenses 21 converts the emitted laser light into a light beam. In the present embodiment, the light beam obtained by the conversion of the coupling lens 21 may be any of a collimated light, a converging light, and a diverging light.

Each of the reflective mirrors 71 reflects a corresponding one of the laser light LY emitted from the light source device 20Y and the laser light LK emitted from the light source device 20K, to the polygon mirror 40. Each of these reflective mirrors 71 is disposed between the polygon mirror 40 and a corresponding one of the light source devices 20M, 20C. It is noted that the laser light LM emitted from the light source device 20M and the laser light LC emitted from the light source device 20C travel over the reflective mirrors 71 to the polygon mirror 40.

To correct a face tangle error of the polygon mirror 40, each first cylindrical lens 30 refracts the laser lights LM, LY or the laser lights LC, LK, converges each light in the sub-scanning direction, and focuses the light into a long line extending in the main scanning direction, on a reflective surface of the polygon mirror 40. Each of these first cylindrical lenses 30 is disposed between the polygon mirror 40 and the light source devices 20Y-20K.

A wall 151 of the casing 100 is provided between the reflective mirrors 71 and the first cylindrical lenses 30 and has a plurality of apertures (see broken lines in FIG. 2A). Each of the laser lights LY-LK passes through a corresponding one of these apertures which defines widths of the passing laser light in the main scanning direction and the sub-scanning direction.

The polygon mirror 40 has six mirror surfaces (i.e., reflective surfaces) provided so as to be spaced apart from a rotation shaft of the polygon mirror 40 at the same distance. These mirror surfaces are rotated about the rotation shaft at a constant speed and reflect the laser lights LY-LK having passed through the first cylindrical lenses 30, to deflect them in the main scanning direction. Specifically, the polygon mirror 40 reflects each two laser lights (LY-LK) emitted from each of the multi-beam lasers LD1-LD4, to deflect the laser light in the main scanning direction. This polygon mirror 40 is disposed in a generally central portion of the casing 100 so as to be opposed to the light source devices 20M, 20C in the right and left direction.

The two fθ lenses 50 are provided on opposite sides of the polygon mirror 40 in the front and rear direction, respectively. Each of the fθ lenses 50 converts the laser lights LY-LK scanned by the polygon mirror 40 at a constant angular speed, so as to scan the laser lights LY-LK over the surfaces of the respective photoconductive drums 251 in the main scanning direction at a constant speed.

As illustrated in FIGS. 2A and 3, to correct a face tangle error of the polygon mirror 40, each of the second cylindrical lenses 60 refracts the laser lights (LY-LK), converges each light in the sub-scanning direction, and focuses the light on the surface of a corresponding one of the photoconductive drums 251. These second cylindrical lenses 60 (60Y-60K) are provided corresponding to the respective four light source devices 20Y-20K.

As illustrated in FIG. 3, the second cylindrical lenses 60M, 60C through which the respective laser lights LM, LC pass are disposed over the respective fθ lenses 50. The second cylindrical lenses 60Y, 60K through which the respective laser lights LY, LK pass are disposed between the respective fθ lenses 50 and respective side walls 120 of the casing 100 which will be described below in a state in which the second cylindrical lenses 60Y, 60K are opposite to the respective side walls 120.

The reflective mirrors 72-75 reflect the laser lights LY-LK, respectively. For example, each of the reflective mirrors 72-75 is formed by vapor deposition of a material having high reflectivity such as aluminum, on a surface of a glass plate which is to serve as a reflective surface.

The reflective mirrors 72 (72M, 72C) are disposed between the respective fθ lenses 50 and the respective second cylindrical lenses 60Y, 60K and respectively reflect the laser lights LM, LC having passed through the fθ lenses 50, to the second cylindrical lenses 60M, 60C. The reflective mirrors 73 (73M, 73C) are disposed over the respective fθ lenses 50 and respectively reflect the laser lights LM, LC having passed through the second cylindrical lenses 60M, 60C, to the surfaces (the scanning surfaces) of the respective photoconductive drums 251M, 251C.

The reflective mirrors 74 (74Y, 74K) are disposed between the respective second cylindrical lenses 60Y, 60K and the respective side walls 120 of the casing 100 along the side walls 120 and respectively reflect the laser lights LY, LK having passed through the second cylindrical lenses 60Y, 60K, to the reflective mirrors 75. The reflective mirrors 75 (75Y, 75K) are disposed over the respective second cylindrical lenses 60Y, 60K and respectively reflect the laser lights LY, LK reflected from the reflective mirrors 74, to the surfaces of the respective photoconductive drums 251Y, 251K.

It is noted that the fθ lenses 50, the second cylindrical lenses 60, and the reflective mirrors 72-75 described above are a plurality of optical systems each of which forms an image on a corresponding one of the photoconductive drums 251 using the laser light deflected by the polygon mirror 40. Pairs of the plurality of optical systems are respectively disposed on opposite sides of the polygon mirror 40 in the front and rear direction. Specifically, the optical systems for yellow and magenta are disposed in front of the polygon mirror 40, and the optical systems for cyan and black are disposed behind the polygon mirror 40. These front optical systems and rear optical systems are arranged symmetrically with respect to a plane extending through the rotation center of the polygon mirror 40 and perpendicular to the front and rear direction.

With the construction as described above, as illustrated in FIG. 2, the two laser lights LM and the two laser lights LC emitted from the respective light source devices 20M, 20C pass through the respective first cylindrical lenses 30 and are deflected by the polygon mirror 40 in the main scanning direction. The two laser lights LY and the two laser lights LK emitted from the respective light source devices 20Y, 20K are reflected by the respective reflective mirrors 71 toward the polygon mirror 40, pass through the respective first cylindrical lenses 30, and are deflected by the polygon mirror 40 in the main scanning direction.

As illustrated in FIG. 3, the two laser lights LM and the two laser lights LC deflected from the polygon mirror 40 respectively pass through the fθ lenses 50, are reflected from the reflective mirrors 72, pass through the second cylindrical lenses 60, are reflected from the reflective mirrors 73, and scan and expose the surfaces of the respective photoconductive drums 251. The two laser lights LY and the two laser lights LK deflected from the polygon mirror 40 respectively pass through the fθ lenses 50 and the second cylindrical lenses 60, are reflected from the reflective mirrors 74 and from the reflective mirrors 75, and scan and expose the surfaces of the respective photoconductive drums 251.

In other words, the two laser lights LY and the two laser lights LM emitted from the respective light source devices 20Y, 20M for yellow and magenta are reflected toward the respective front optical systems by one of the mirror surfaces (i.e., the same mirror surface) of the polygon mirror 40, which surface has been successively moved to an obliquely front and left position at which the laser lights LY, LM impinge on the polygon mirror 40. The two laser lights LC and the two laser lights LK emitted from the respective light source devices 20C, 20K for cyan and black are reflected toward the respective rear optical systems by one of the mirror surfaces (i.e., the same mirror surface) of the polygon mirror 40, which surface has been successively moved to an obliquely rear and left position at which the laser lights LC, LK impinge on the polygon mirror 40.

It is noted that FIGS. 3 and 1 exaggerate the distance between the two laser lights of each color in the sub-scanning direction for easy understanding.

Figure 4:
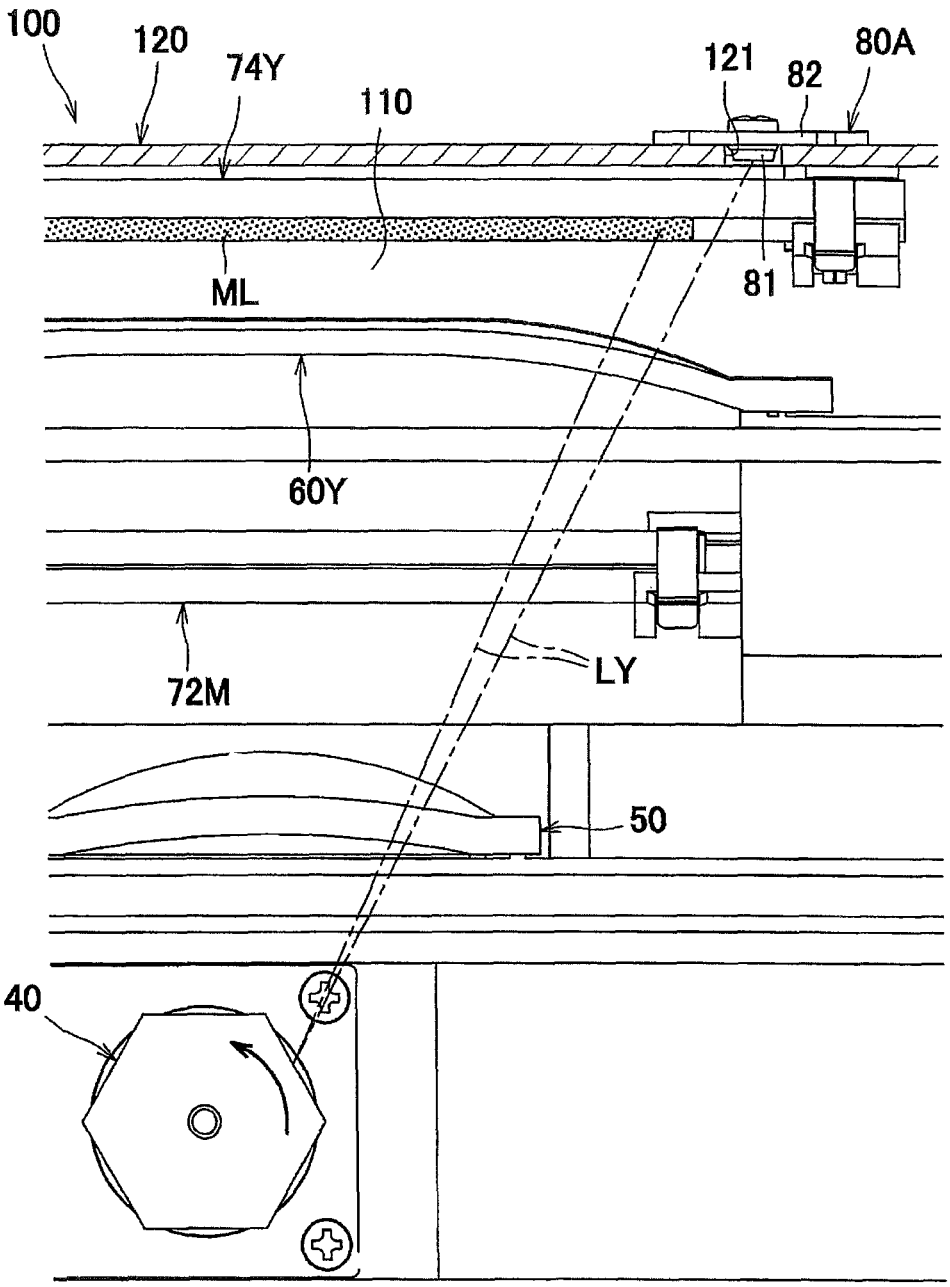
FIG. 4 is an enlarged plan view illustrating the scanner unit.

As illustrated in FIG. 4, the only one writing sensor 80A, provided in the scanner unit 1, includes a beam detector 81 configured to detect one of the laser lights LY, and a circuit board 82 to which the beam detector 81 is assembled. Specifically, the beam detector 81 is configured to detect the laser light LY emitted from the one light emitting portion, namely, the light emitting portion LD11 among the light emitting portions LD11, LD12, . . . , and LD42 of the multi-beam lasers LD1-LD4, that is, the beam detector 81 is configured to detect the laser light LY emitted from the light emitting portion LD11 among all the light emitting portions LD11, LD12, . . . , and LD42 in the scanner unit 1.

This writing sensor 80A is mounted on an outer surface of the side wall 120 of the casing 100 so as to close an opening 121 formed in the side wall 120, whereby the beam detector 81 is disposed, with its detection surface facing the inside of the casing 100. The writing sensor 80A outputs a writing start signal to the controller 300 when the laser light LY is detected by the beam detector 81. The writing start signal is for determination of timings of start of scanning (i.e., timings for emission of exposure laser lights from the light emitting portions LD11, LD12, . . . , and LD42 of the light source devices 20). Here, each of the exposure laser lights is a laser light for exposing the surface of a corresponding one of the photoconductive drums 251 based on image data.

It is noted that the reflective mirror 74Y is constructed such that its one end portion in the longitudinal direction allows the laser light LY to pass therethrough. Specifically, the reflective mirror 74Y formed by vapor deposition of a material having high reflectivity on the surface of the glass plate has a portion corresponding to the writing sensor 80A, and a mirror layer ML indicated with dots in FIG. 4 is not formed on the portion corresponding to the writing sensor 80A. As a result, the beam detector 81 can detect the laser light LY passing through the end portion of the reflective mirror 74Y. More specifically, the writing sensor 80A is disposed upstream of the mirror layer ML in the scanning direction of the laser light LY.

As illustrated in FIG. 2A, the single correction sensor 80B, provided in the scanner unit 1, has a structure similar to that of the writing sensor 80A. The correction sensor 80B is mounted at a portion of the rear side wall 120 in the same method as that for the writing sensor 80A.

Specifically, the correction sensor 80B is disposed downstream of the mirror layer ML, not shown, of the reflective mirror 74K in the scanning direction of the laser light LK, and can detect the single laser light LK. Specifically, the beam detector 81 of the correction sensor 80B is configured to detect the laser light LK emitted from the one light emitting portion, namely, the light emitting portion LD41 among the light emitting portions LD11, LD12, . . . , and LD42 of the multi-beam lasers LD1-LD4. Upon detecting the laser light LK, the correction sensor 80B outputs a correction signal to the controller 300. The correction signal is for correcting a displacement of an exposure position due to thermal expansion of the scanner unit 1.

The casing 100 contains the light source devices 20, the polygon mirror 40, the second cylindrical lenses 60, and the reflective mirrors 71-75, for example. This casing 100 includes a support wall 110 and the side walls 120 standing upright respectively on opposite end portions of the support wall 110 in the front and rear direction.

The support wall 110 is a lower wall (i.e., a bottom wall) of the casing 100 and supports the light source devices 20, the polygon mirror 40, the fθ lenses 50, the second cylindrical lenses 60Y, 60K, and the reflective mirrors 72, 74, for example. As illustrated in FIG. 3, the support wall 110 has four exposure openings 111-114 arranged in the front and rear direction. Each of the laser lights LY-LK reflected from a corresponding one of the reflective mirrors 73, 75 to the surface of the corresponding photoconductive drum 251 passes through a corresponding one of the exposure openings 111-114.

As illustrated in FIG. 1, the controller 300 is provided in the body housing 210 and includes: a CPU; a body memory 310, as one example of a body-side storage, having a RAM, a ROM, and other similar devices; and an input/output circuit. The controller 300 is connected to the scanner unit 1 and configured to receive the signals from the sensors 80A, 80B of the scanner unit 1 and refer to information stored in the memory 11 of the scanner unit 1 to control the light emitting portions LD11, LD12, . . . , and LD42 of the light source devices 20 of the scanner unit 1. In the following explanation, each light emitting portion assigned with a reference numeral ending in 1 may also be referred to as "first light emitting portion", and each light emitting portion assigned with a reference numeral ending in 2 may also be referred to as "second light emitting portion" for easy understanding.

As illustrated in FIG. 5, the body memory 310 stores reference values T11-T41 for the respective first light emitting portions LD11-LD41. Each of the reference values T11-T41 is a writing time which is a length of time extending from detection of the laser light LY by the writing sensor 80A, to emission of the exposure laser light (LY-LK) from a corresponding one of the first light emitting portions LD11-LD41. Here, each of the reference values T11, T21 for yellow and magenta can be set at 14.619 μs, for example, and each of the reference values T31, T41 for cyan and black can be set at 131.917 μs, for example. It is noted that each of the reference values T11-T41 is a design value, without tolerance taken into consideration.

It is noted that the same value can be used for the reference values T11, T21 for yellow and magenta because the laser lights LY, LM are scanned over one mirror surface (the same mirror surface) of the polygon mirror 40. Likewise, the same value can be used for the reference values T31, T41 for cyan and black because the laser lights LC, LK are scanned over one mirror surface (the same mirror surface) of the polygon mirror 40. Each of the reference values T31, T41 for cyan and black is larger than each of the reference values T11, T21 for yellow and magenta for the following reason: the laser lights LC, LK are scanned over the mirror surface of the polygon mirror 40 which is different from the mirror surface thereof on which the laser lights LY, LM impinge, causing a time difference between a time at which each of the laser lights LY, LM for yellow and magenta reaches a writing starting position and a time at which each of the laser lights LC, LK for cyan and black reaches a writing starting position.

As illustrated in FIG. 6A, the memory 11 of the scanner unit 1 stores deviation amounts ΔT11-ΔT41 as parameters relating to the writing times for the respective first light emitting portions LD11-LD41. Each of the deviation amounts ΔT11-ΔT41 is an amount of deviation of the writing time for a corresponding one of the first light emitting portions LD11-LD41 from the corresponding reference value. Here, the writing time for each of the first light emitting portions LD11-LD41 is measured at manufacturing of the color printer 200, and a corresponding one of the deviation amounts ΔT11-ΔT41 is calculated as a difference between the corresponding reference value and the measured value, for example. Specifically, in the case where the reference value T11 of the writing time for the first light emitting portion LD11 is 14.619 μs, and the measured value of the writing time is 14.446 μs, for example, the deviation amount ΔT11 is set at −0.173 μs.

As illustrated in FIG. 6B, the memory 11 stores, for each of the second light emitting portions LD12-LD42, a time difference in writing time (e.g., ΔT1) between two light emitting portions (e.g., LD11, LD12) of one of the multi-beam lasers (e.g., LD1), as a parameter relating to the writing time. Here, each of the time differences ΔT1-ΔT4 is a time difference which is caused due to a distance (the first distance D1) between the first light emitting portion and the second light emitting portion in the main scanning direction.

It is noted that the writing times of all the light emitting portions LD11, LD12, . . . , and LD42 are measured at manufacturing of the color printer 200, and the time differences ΔT1-ΔT4 are calculated by respectively subtracting measured values of the writing times of the respective first light emitting portions LD11-LD41 from measured values of the writing time for the respective second light emitting portions LD12-LD42, for example. Specifically, in the case where the measured value of the writing time for the second light emitting portion LD12 is 14.827 μs, and the measured value of the writing time for the first light emitting portion LD11 is 14.446 μs, for example, the time difference ΔT1 is set at −0.381 μs.

Each of the above-described parameters is stored in a corresponding one of the memory 11 and the body memory 310 in units of the particular number of bits. A length of time corresponding to a quantization unit of the parameter (i.e., a length of time indicated by a difference in a least significant bit of the particular number of bits) is shorter than or equal to a scan time for one pixel. Here, the scan time is a length of time required for scanning a certain length on the surface of the photoconductive drum 251, and the scan time for one pixel is a length of time required for scanning one pixel.

Specifically, in the case where the scan time for one pixel is 0.02 μs, for example, the time corresponding to the quantization unit of the parameter can be set at a time shorter than or equal to 0.02 μs (e.g., 0.001 μs). Since the time corresponding to the quantization unit of the parameter is set as described above, in the case where the least significant bit of the number of bits is changed from 0 to 1, the parameter (the time) increases by a unit time (e.g., 0.001 μs) shorter than or equal to the scan time for one pixel.

The controller 300 controls the timing of emission of each of the exposure laser lights LY-LK from a corresponding one of the light emitting portions LD11, LD12, . . . , and LD42 based on results of detection of the writing sensor 80A and the correction sensor 80B and the parameters stored in the memory 11 and the body memory 310. Specifically, in the case where the controller 300 controls the first light emitting portions LD11-LD41, the controller 300 first calculates the writing times T1-T4 for the respective first light emitting portions LD11-LD41 by adding the deviation amounts ΔT11-ΔT41 stored in the memory 11, to the respective reference values T11-T41 stored in the body memory 310.

The controller 300 then calculates a correction value for each color based on a difference between a time at which the laser light LY is detected by the writing sensor 80A and a time at which the laser light LK is detected by the correction sensor 80B. The correction value is for correction of change in writing time due to thermal expansion of the scanner unit 1. The controller 300 then uses the same correction value to correct parameters (e.g., the writing time T1 and the time difference ΔT1) respectively corresponding to two light emitting portions (e.g., LD11, LD12) of one multi-beam laser (e.g., LD1).

The controller 300 then controls the timing of emission of each of the exposure laser lights LY-LK from a corresponding one of the light emitting portions LD11, LD12, . . . , and LD42 based on the result of detection of the writing sensor 80A, the writing times T1-T4 corrected using the correction values, and the time differences ΔT1-ΔT4 corrected using the correction values.

Figure 7:
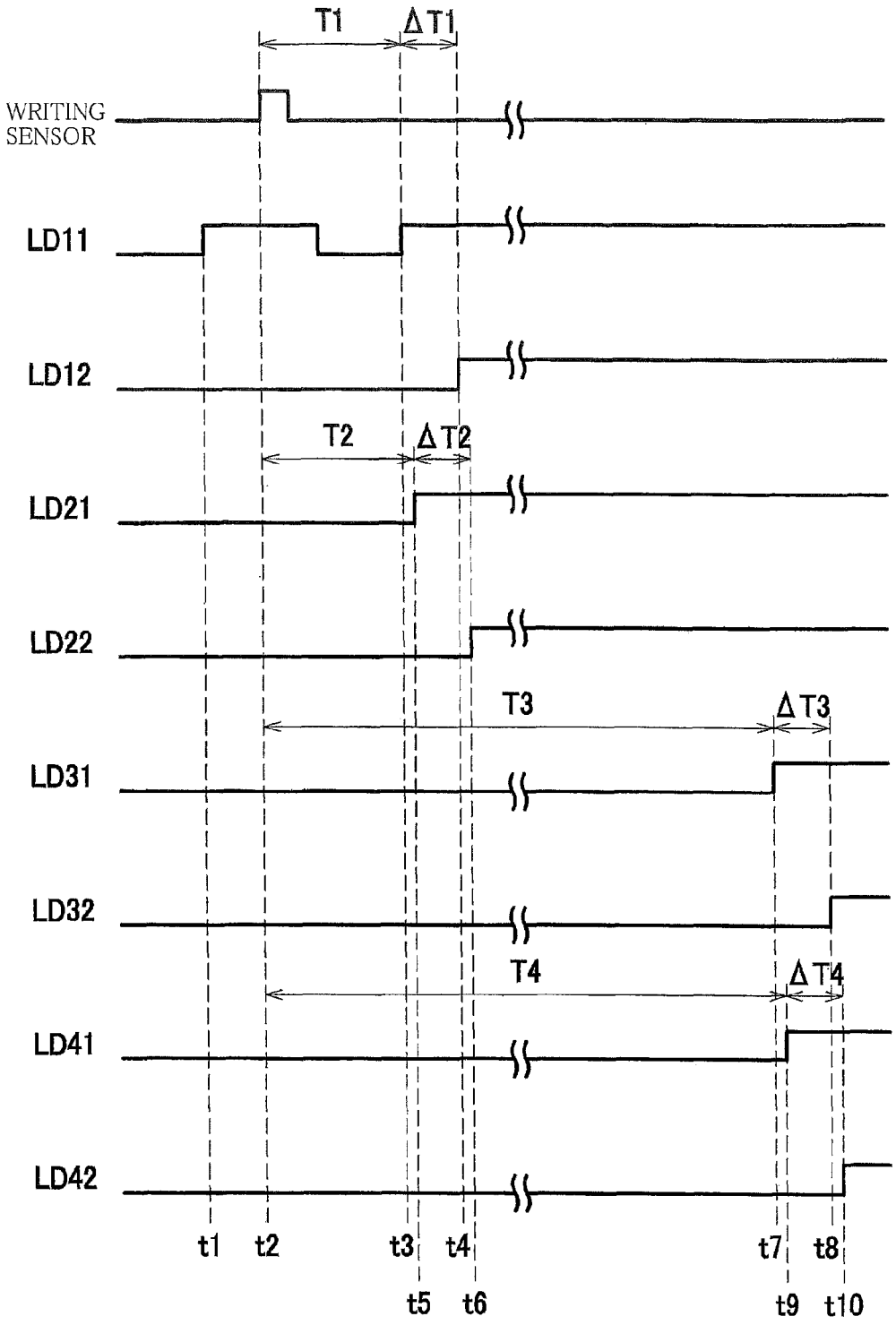
FIG. 7 is a time chart illustrating a timing of emission of an exposure laser light emitted from each of light emitting portions.

There will be next explained control of the controller 300 in detail with reference to FIG. 7. It is assumed that the correction value for each color is zero in the following explanation for easy understanding.

As illustrated in FIG. 7, the controller 300 controls the multi-beam laser LD1 to emit the laser light LY not for exposure from the first light emitting portion LD11 for yellow for a predetermined length of time at a predetermined timing after a print instruction received or the completion of scanning of the exposure laser light LY by one line (time t1). When the laser light LY is detected by the writing sensor 80A (time t2), the controller 300 determines whether or not the writing time T1 for yellow (=T11+ΔT11) has passed from the detection of the laser light LY by the writing sensor 80A.

When the writing time T1 has passed from time t2 (time t3), the controller 300 controls the multi-beam laser LD1 to emit the exposure laser light LY from the first light emitting portion LD11 for yellow. When the time difference ΔT1 has passed from time t3 (time t4), the controller 300 controls the multi-beam laser LD1 to emit the exposure laser light LY from the second light emitting portion LD12 for yellow. As a result, writing starting positions of the respective two laser lights LY emitted from the multi-beam laser LD1 for yellow are aligned to each other, and the two laser lights LY are scanned over the photoconductive drum 251Y (see FIG. 3).

When the writing time T2 (=T21+ΔT21) has passed from time t2 (time t5), the controller 300 controls the multi-beam laser LD2 to emit the exposure laser light LM from the first light emitting portion LD21 for magenta. When the time difference ΔT2 has passed from time t5 (time t6), the controller 300 controls the multi-beam laser LD2 to emit the exposure laser light LM from the second light emitting portion LD22 for magenta. As a result, writing starting positions of the respective two laser lights LM emitted from the multi-beam laser LD2 for magenta are aligned to each other, and the two laser lights LM are scanned over the photoconductive drum 251M (see FIG. 3). It is noted that the reference values T11, T21 for T1 and T2 are equal to each other, and accordingly time t3 and time t5 are the same as each other in the case where the deviation amount ΔT11 and the deviation amount ΔT21 are equal to each other.

When the writing time T3 (=T31+ΔT31) has passed from time t2 (time t7), the controller 300 controls the multi-beam laser LD3 to emit the exposure laser light LC from the first light emitting portion LD31 for cyan. When the time difference ΔT3 has passed from time t7 (time t8), the controller 300 controls the multi-beam laser LD3 to emit the exposure laser light LC from the second light emitting portion LD32 for cyan. As a result, writing starting positions of the respective two laser lights LC emitted from the multi-beam laser LD3 for cyan are aligned to each other, and the two laser lights LC are scanned over the photoconductive drum 251C (see FIG. 3).

When the writing time T4 (=T41+ΔT41) has passed from time t2 (time t9), the controller 300 controls the multi-beam laser LD4 to emit the exposure laser light LK from the first light emitting portion LD41 for black. When the time difference ΔT4 has passed from time t9 (time t10), the controller 300 controls the multi-beam laser LD4 to emit the exposure laser light LK from the second light emitting portion LD42 for black. As a result, writing starting positions of the respective two laser lights LK emitted from the multi-beam laser LD4 for black are aligned to each other, and the two laser lights LK are scanned over the photoconductive drum 251K (see FIG. 3). It is noted that the reference values T31, T41 for T3 and T4 are equal to each other, and accordingly time t7 and time t9 are the same as each other in the case where the deviation amount ΔT31 and the deviation amount ΔT41 are equal to each other.

The following effects can be obtained in the present embodiment.

In the present embodiment, only the result of detection of one writing sensor 80A can be used to control the timing of emission of each of the exposure laser lights LY-LK from a corresponding one of the light emitting portions LD11, LD12, and LD42. This configuration eliminates the need of a plurality of writing sensors, resulting in a simple construction.

The time corresponding to the quantization unit of the parameter is set at a time shorter than or equal to the scan time for one pixel in the present embodiment. Accordingly, the timing of emission of each of the exposure laser lights LY-LK from a corresponding one of the light emitting portions LD11, LD12, . . . , and LD42 can be controlled in units of shorter than or equal to the scan time for one pixel.

The deviation amounts ΔT11-ΔT41 with respect to the respective reference values T11-T41 of the writing time are stored in the memory 11 in the present embodiment. This configuration requires a smaller number of bits for storage when compared with a configuration in which measured values of the writing time are stored in the memory, for example, resulting in a smaller data amount. Specifically, in the case where, for example, the measured value of the writing time is 14.446 μs, and the deviation amount ΔT11 is −0.173 μs as described above, the measured value and the deviation amount differ from each other by two in the number of digits in decimal number system, resulting in a smaller number of bits of the deviation amount by an amount corresponding to the amount of difference.

In the present embodiment, the time difference in writing time (e.g., ΔT1) between two light emitting portions (e.g., LD11, LD12) of one multi-beam laser (e.g., LD1) is stored in the memory 11 for each of the second light emitting portions LD12-LD42. A smaller number of bits for storage can be reduced when compared with a configuration in which measured values of writing times corresponding to the respective second light emitting portions LD12-LD42 are stored in the memory, for example, resulting in a smaller data amount. Specifically, in the case where, for example, the measured value of the writing time for the second light emitting portion LD12 is 14.827 μs, and the time difference ΔT1 is −0.381 μs as described above, the measured value and the time difference differ from each other by two in the number of digits in decimal number system, resulting in a smaller number of bits of time difference by an amount corresponding to the amount of difference.

In the present embodiment, the same correction value is used to correct parameters respectively corresponding to two light emitting portions (e.g., LD11, LD12) of one multi-beam laser (e.g., LD1) based on the result of detection of the correction sensor 80B. Accordingly, even in the case where the parameters are corrected to eliminate effects of thermal expansion, it is possible to reduce a difference in timings of emission of exposure laser lights from a pair of light emitting portions (e.g., LD11, LD12) for the same color.

Since the memory 11 is provided in the scanner unit 1, the memory 11 can be replaced together with the scanner unit 1 in replacement of the scanner unit 1. Accordingly, in the case where the color printer 200 is configured such that parameters are set so as to respectively correspond to manufacturing errors for respective scanner units 1, for example, only replacement of the scanner unit 1 allows the controller 300 to satisfactorily control the timing of emission of each of the exposure laser lights LY-LK based on a new parameter.

In the present embodiment, the reference values T11-T41 of the writing times are stored in the body memory 310 provided in the body housing 210. Accordingly, when compared with a configuration in which the reference values are stored in the memory of the scanner unit, for example, a smaller storage capacity is required for the memory 11 of the scanner unit 1, resulting in lower manufacturing cost of the scanner unit 1.

It is to be understood that the disclosure is not limited to the details of the illustrated embodiment, but may be embodied with various changes and modifications, which may occur to those skilled in the art, without departing from the spirit and scope of the disclosure.

While the deviation amounts ΔT11-ΔT41 and the time differences ΔT1-ΔT4 are stored in the memory 11 in the above-described embodiment, this disclosure is not limited to this configuration. For example, measured values of the writing times for the respective light emitting portions may be stored in the memory. In this configuration, however, a larger storage capacity is required for the memory when compared with the configuration in the above-described embodiment. Accordingly, the configuration in the above-described embodiment is preferable.

The photoconductive drums 251 are taken each as one example of the photoconductor in the above-described embodiment, but this disclosure is not limited to this configuration. For example, a photoconductor in the form of a belt may be employed.

The present disclosure is applied to the color printer 200 in the above-described embodiment but may be applied to other image forming apparatuses such as a copying machine and a multi-function peripheral (MFP).

What is claimed is:

1. An image forming apparatus, comprising:

an exposing device configured to expose surfaces of a plurality of photoconductors;

a storage; and a controller, wherein the exposing device comprises:

a plurality of light sources comprising a plurality of light emitting portions and provided respectively corresponding to the plurality of photoconductors;

a deflector configured to deflect light emitted from each of the plurality of light emitting portions of the plurality of light sources;

a plurality of optical systems each configured to use the light deflected by the deflector to form an image on a corresponding one of the plurality of photoconductors; and a first beam detector configured to detect reference light emitted from one of the plurality of light emitting portions and deflected by the deflector, wherein the storage is configured to store a plurality of parameters respectively for the plurality of light emitting portions, the plurality of parameters each relating to a writing time extending from a timing of the detection of the reference light by the first beam detector to a timing of emission of light for exposing a corresponding one of the surfaces of the plurality of photoconductors from a corresponding one of the plurality of light emitting portions, wherein the controller is configured to control the timing of emission of light from each of the plurality of light emitting portions for exposing a corresponding one of the surfaces of the plurality of photoconductors, based on a result of the detection of the reference light by the first beam detector and a corresponding one of the plurality of parameters stored in the storage, wherein the storage is configured to store each of the plurality of parameters in a particular number of bits, and wherein a time corresponding to a quantization unit of each of the plurality of parameters is less than or equal to a scan time for one pixel.

2. The image forming apparatus according to claim 1, wherein the storage is configured to store, as each of the plurality of parameters, a deviation amount with respect to a reference value of the writing time.

3. The image forming apparatus according to claim 1, wherein the storage is configured to store, as each of the plurality of parameters, a difference in the writing time between a plurality of light emitting portions of one of the plurality of light sources.

4. The image forming apparatus according to claim 1, further comprising a second beam detector configured to detect light emitted from one of the plurality of light emitting portions, wherein one of the plurality of light sources comprises at least two of the plurality of light emitting portions, to which at least two of the plurality of parameters respectively correspond, and wherein the controller is configured to correct the at least two of the plurality of parameters using an identical correction value based on a result of detection of the second beam detector to correct a displacement of an exposure position due to thermal expansion of the exposing device.

5. The image forming apparatus according to claim 1, wherein at least one of the plurality of optical systems and at least one other of the plurality of optical systems are respectively arranged on opposite sides of the deflector.

6. The image forming apparatus according to claim 1, wherein the storage is provided in the exposing device.

7. The image forming apparatus according to claim 1, wherein the storage is configured to store, as each of the plurality of parameters, a deviation amount with respect to a reference value of the writing time, wherein the storage is provided in the exposing device, and wherein a body-side storage configured to store a reference value of the writing time is provided in a body housing holding the exposing device.

8. An image forming apparatus, comprising:

an exposing device configured to expose surfaces of a plurality of photoconductors;

a storage; and a controller, wherein the exposing device comprises:

a plurality of light sources comprising a plurality of light emitting portions and provided respectively corresponding to the plurality of photoconductors;

a deflector configured to deflect light emitted from each of the plurality of light emitting portions of the plurality of light sources;

a plurality of optical systems each configured to use the light deflected by the deflector to form an image on a corresponding one of the plurality of photoconductors; and a first beam detector configured to detect reference light emitted from one of the plurality of light emitting portions and deflected by the deflector, wherein the storage is configured to store a plurality of parameters respectively for the plurality of light emitting portions, the plurality of parameters each relating to a writing time extending from a timing of the detection of the reference light by the first beam detector to a timing of emission of light for exposing a corresponding one of the surfaces of the plurality of photoconductors from a corresponding one of the plurality of light emitting portions, wherein the controller is configured to control the timing of emission of light from each of the plurality of light emitting portions for exposing a corresponding one of the surfaces of the plurality of photoconductors, based on a result of the detection of the reference light by the first beam detector and a corresponding one of the plurality of parameters stored in the storage, and wherein the storage is configured to store, as each of the plurality of parameters, a deviation amount with respect to a reference value of the writing time.

9. The image forming apparatus according to claim 8, wherein the storage is configured to store each of the plurality of parameters in a particular number of bits, and wherein a time corresponding to a quantization unit of each of the plurality of parameters is less than or equal to a scan time for one pixel.

10. The image forming apparatus according to claim 8, wherein the storage is configured to store, as each of the plurality of parameters, a difference in the writing time between a plurality of light emitting portions of one of the plurality of light sources.

11. The image forming apparatus according to claim 8, further comprising a second beam detector configured to detect light emitted from one of the plurality of light emitting portions, wherein one of the plurality of light sources comprises at least two of the plurality of light emitting portions, to which at least two of the plurality of parameters respectively correspond, and wherein the controller is configured to correct the at least two of the plurality of parameters using an identical correction value based on a result of detection of the second beam detector to correct a displacement of an exposure position due to thermal expansion of the exposing device.

12. The image forming apparatus according to claim 8, wherein at least one of the plurality of optical systems and at least one other of the plurality of optical systems are respectively arranged on opposite sides of the deflector.

13. The image forming apparatus according to claim 8, wherein the storage is provided in the exposing device.

14. The image forming apparatus according to claim 8, wherein the storage is configured to store, as each of the plurality of parameters, a deviation amount with respect to a reference value of the writing time, wherein the storage is provided in the exposing device, and wherein a body-side storage configured to store a reference value of the writing time is provided in a body housing holding the exposing device.

15. An image forming apparatus, comprising:

an exposing device configured to expose surfaces of a plurality of photoconductors;

a storage; and a controller, wherein the exposing device comprises:

a plurality of light sources comprising a plurality of light emitting portions and provided respectively corresponding to the plurality of photoconductors;

a deflector configured to deflect light emitted from each of the plurality of light emitting portions of the plurality of light sources;

a plurality of optical systems each configured to use the light deflected by the deflector to form an image on a corresponding one of the plurality of photoconductors; and a first beam detector configured to detect reference light emitted from one of the plurality of light emitting portions and deflected by the deflector, wherein the storage is configured to store a plurality of parameters respectively for the plurality of light emitting portions, the plurality of parameters each relating to a writing time extending from a timing of the detection of the reference light by the first beam detector to a timing of emission of light for exposing a corresponding one of the surfaces of the plurality of photoconductors from a corresponding one of the plurality of light emitting portions, wherein the controller is configured to control the timing of emission of light from each of the plurality of light emitting portions for exposing a corresponding one of the surfaces of the plurality of photoconductors, based on a result of the detection of the reference light by the first beam detector and a corresponding one of the plurality of parameters stored in the storage, wherein the storage is configured to store, as each of the plurality of parameters, a deviation amount with respect to a reference value of the writing time, wherein the storage is provided in the exposing device, and wherein a body-side storage configured to store a reference value of the writing time is provided in a body housing holding the exposing device.

16. The image forming apparatus according to claim 15, wherein the storage is configured to store each of the plurality of parameters in a particular number of bits, and wherein a time corresponding to a quantization unit of each of the plurality of parameters is less than or equal to a scan time for one pixel.

17. The image forming apparatus according to claim 15, wherein the storage is configured to store, as each of the plurality of parameters, a deviation amount with respect to a reference value of the writing time.

18. The image forming apparatus according to claim 15, wherein the storage is configured to store, as each of the plurality of parameters, a difference in the writing time between a plurality of light emitting portions of one of the plurality of light sources.

19. The image forming apparatus according to claim 15, further comprising a second beam detector configured to detect light emitted from one of the plurality of light emitting portions, wherein one of the plurality of light sources comprises at least two of the plurality of light emitting portions, to which at least two of the plurality of parameters respectively correspond, and wherein the controller is configured to correct the at least two of the plurality of parameters using an identical correction value based on a result of detection of the second beam detector to correct a displacement of an exposure position due to thermal expansion of the exposing device.

20. The image forming apparatus according to claim 15, wherein at least one of the plurality of optical systems and at least one other of the plurality of optical systems are respectively arranged on opposite sides of the deflector.

* * * * *